US005907939A

United States Patent [19]

Reichel

[11] Patent Number: 5,907,939

[45] Date of Patent: Jun. 1, 1999

[54] MASONRY HANGER

[76] Inventor: Kurt O. Reichel, 65 Walapai Dr., Sedona, Ariz. 86339

[21] Appl. No.: 09/089,010

[22] Filed: Jun. 2, 1998

[51] Int. Cl.[6] ..... E04C 5/16

[52] U.S. Cl. ..... 52/698; 52/431; 52/432; 52/442; 52/677; 52/686; 52/702

[58] Field of Search ..... 52/421, 426, 427, 52/431, 562, 677, 432, 607, 442, 698, 686, 702

[56] References Cited

U.S. PATENT DOCUMENTS

| | | | |
|---|---|---|---|
| 1,578,947 | 3/1926 | Alber | 52/677 |
| 2,261,510 | 11/1941 | Atcheson | 52/715 |
| 2,467,115 | 4/1949 | Duggan | 52/677 |
| 2,887,869 | 5/1959 | McKay . | |
| 3,109,260 | 11/1963 | Cesare . | |
| 4,337,605 | 7/1982 | Tudek . | |
| 4,565,043 | 1/1986 | Mazzarese . | |
| 4,742,659 | 5/1988 | Meilleur | 52/562 X |
| 4,888,931 | 12/1989 | Meilleur | 52/426 |
| 5,065,561 | 11/1991 | Mason | 52/562 X |
| 5,099,628 | 3/1992 | Noland et al. . | |
| 5,390,459 | 2/1995 | Mensen | 52/426 |

*Primary Examiner*—Christopher Kent
*Attorney, Agent, or Firm*—Cahill, Sutton & Thomas P.L.C.

[57] ABSTRACT

A reinforcing bar support or hanger for use in a masonry block wall incorporates a pair of supporting arms for contacting the surface of a supporting block and includes vertically extending hanger members terminating in a rebar cradle for receiving and supporting a rebar to be positioned within the wall. The support arms have a transverse length less than the transverse thickness of the masonry wall and the vertical thickness of the support arms is equal to or less than the thickness of the mortar joints between successive courses of the wall. The hanger may include longitudinally extending ridges for assisting in the transverse positioning of the hanger within the masonry block.

7 Claims, 3 Drawing Sheets

MASONRY HANGER

FIELD OF THE INVENTION

The present invention relates to masonry wall systems, and more particularly to such masonry systems requiring the inclusion of reinforcing bars within the wall.

BACKGROUND OF THE INVENTION

Masonry wall systems frequently require the utilization of means for stabilizing, strengthening and insuring masonry wall system integrity; such requirements are usually met through the use of vertically extending reinforcing bars (rebar) that extends through the voids in the successive courses of masonry block and is anchored in the wall system footing. However, wall systems also frequently require the inclusion of horizontal rebar that must be positioned within the wall system and temporarily supported in position until mortar or grout completely encases the rebar. The Uniform Building Code requires that such rebar be maintained distant from any surface of a masonry block and shall be spaced not less than ¼ to ½" depending on the particular grout used in the construction. The Code also requires that the rebar be completely imbedded in mortar or grout and that it be held in position during the pouring of the grout.

In the field, it is difficult to always obtain compliance with the Code since the positioning of longitudinal or horizontal rebar within a masonry wall system may be time consuming and always requires care; the pressures of time schedules frequently result in the abandonment of strict Code compliance and proper support is frequently not provided for the horizontally extending rebar prior to the introduction of grout material.

OBJECTS OF THE INVENTION

It is therefore an object of the present invention to provide a horizontal rebar hanger for temporarily positioning a horizontally extending rebar within a masonry wall system prior to the pouring of grout around the rebar.

It is another object of the present invention to provide a rebar hanger that is inexpensive and easy to use to facilitate the proper positioning of rebar within a masonry wall system.

It is still another object of the present invention to provide a rebar hanger that is readily adaptable for supporting one or more horizontally extending rebars within a masonry wall system.

It is still a further object of the present invention to provide a rebar hanger that may be placed anywhere along the block wall and does not require any special block configuration while providing support for different sizes of rebar within the masonry block system.

SUMMARY OF THE INVENTION

The present invention accomplishes the above objects through the utilization of a unique structure formed of a rigid material such as plastic having support arms that are placed on top of a masonry block and having vertically extending hanger members that extend downwardly into the block with a rebar cradle at the end thereof for receiving and temporarily supporting a rebar horizontally extending through the masonry wall system. The plastic material may be formed in any convenient manner such as by injection molding or by extrusion. The vertical thickness of the support arms of the hanger are equal to or less than the thickness of the mortar at the mortar joint between successive courses of the masonry block wall to thereby obviate the need for special block configurations for supporting the hangers and to thereby permit the hangers to be placed anywhere along the length of the wall that a hanger may be required. The strength of the hanger may readily be chosen to support the desired or required rebar size by choosing the longitudinal length of the hanger; for example, if the hanger is extruded, the longitudinal length of the hanger may be cut from the extrusion to correspond to the physical strength required for that hanger to support the rebar being used. The rigidity of the hanger material insures that the transverse positioning of the rebar.

BRIEF DESCRIPTION OF THE DRAWINGS

The present invention may more readily be described by reference to the accompanying drawings in which.

DETAILED DESCRIPTION OF THE PREFERRED EMBODIMENT

Figure 1:
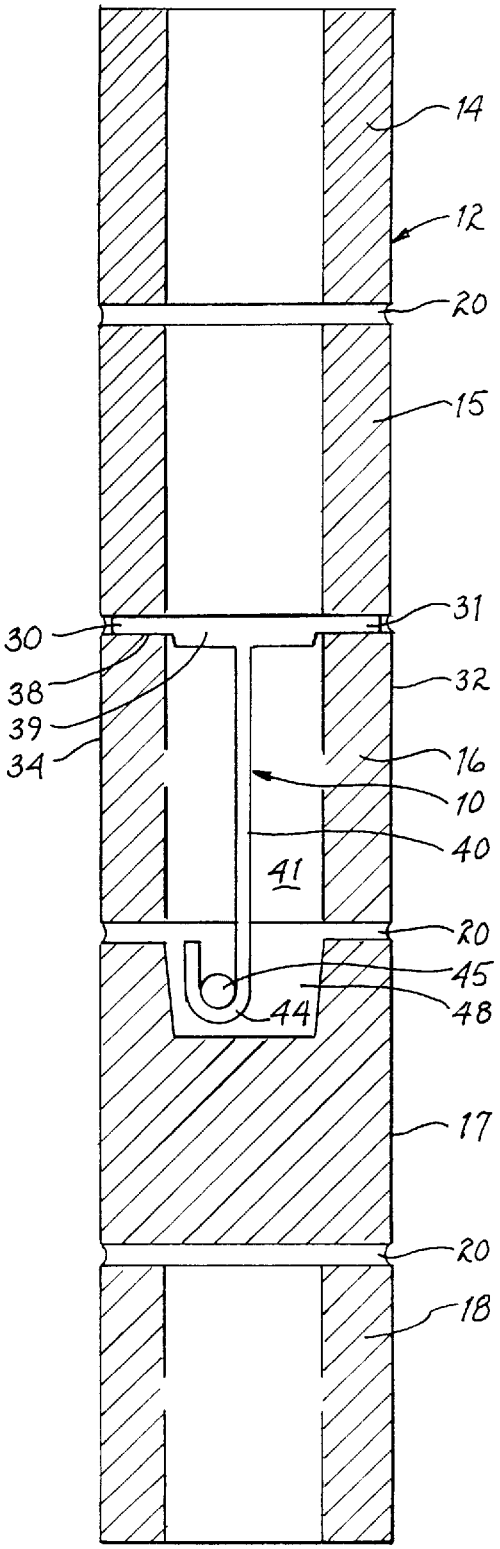
FIG. 1 is a cross-sectional view of a masonry hanger constructed in accordance with the teachings of the present invention and showing the hanger in position within a masonry wall system.

Referring now to FIG. 1, a masonry hanger 10 is shown constructed in accordance with the teachings of the present invention. A masonry block wall 12 incorporating a plurality of courses 14, 15, 16, 17 and 18 of masonry block are separated by horizontal mortar joints 20 in a conventional manner. The wall may be positioned on a footer (not shown) and may also incorporate vertically extending rebar (not shown). Building plans frequently require a horizontal longitudinally extending rebar to be positioned and secured within the wall to stabilize, strengthen and ensure the masonry wall system integrity. As stated previously, the Universal Building Code requires that the surface of any rebar not contact the surface of any masonry block through which it passes and that the rebar be held in position while the mortar or grout is added to the interior of the block to imbed the rebar therein. The rebar hanger 10 is provided having support arms 30 and 31 extending horizontally between the front and rear faces 32 and 34, respectively, of a supporting block 16; the support arms extend transversely of the masonry block wall a distance slightly less than the width or thickness of the wall.

The support arms incorporate a vertical thickness equal to or slightly less than the vertical thickness of the mortar joint used to separate the supporting block 16 from the course of the masonry block 15 immediately above. Such mortar joints are created in the field by the mason laying the block and have a nominal standardized vertical thickness. Since the vertical thickness of the support arms 30 and 31 is equal to or less than the vertical thickness of the mortar joint, the hanger 10 may be placed anywhere along the top surface 38 of the supporting block 16 without requiring any special design or modification to the supporting block and may therefore be utilized with any standard masonry units or block designs. Further, the supporting arms 30 and 31, and the rebar hanger of which they form a part, may be placed anywhere along the length of the masonry wall to form one of a group of supports distributed at any desired interval that may be required to support the weight of the rebar.

A vertically extending hanger member 40 extends downwardly through the void 41 in the supporting block 16 and terminates in a reinforcing bar cradle 44 for contacting and supporting the rebar 45. The rebar is supported within a grout or mortar channel 48 extending horizontally within the masonry block 17 positioned beneath the supporting block 16. The mortar channel 48, with the rebar 45 supported therein, is then filled with grout or mortar to embed the rebar in the block 17 (and adjacent blocks in that same course) and form a bond beam. Transverse positioning of the rebar is assured by the selection of the rigid, relatively inflexible plastic material of the hanger and the chosen thickness of the vertically extending hanger member 40. To further add to the transverse stability of the hanger, a strengthening ridge such as that shown at 39 may be included; it will be apparent to those skilled in the art that the ridge 39 may be extended downwardly to add additional transverse rigidity. Other transverse strengthening designs may be incorporated but the design must account for the fact that the hanger is extruded or injection molded. For example, the vertically extending hanger member 40 may take the form of the vertically extending hanger member 59 of FIG. 2.

Figure 2:
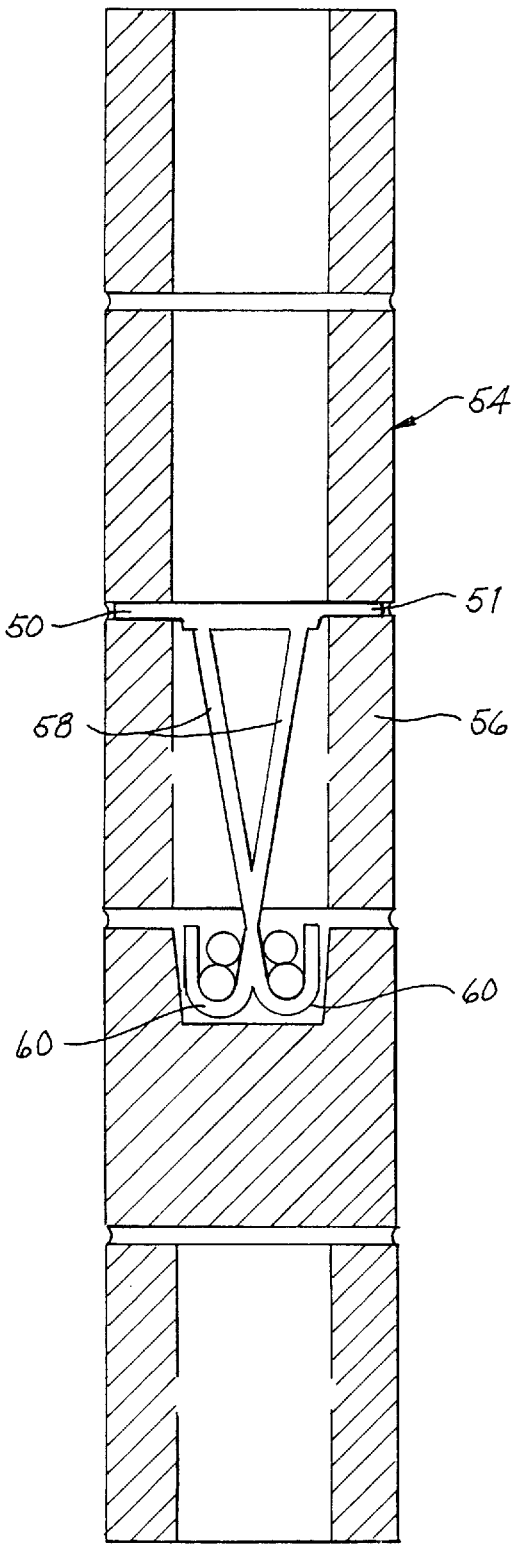
FIG. 2 is a cross-sectional view of another embodiment of the masonry wall hanger of the present invention shown in position supporting plural rebars within a masonry wall system.
Figure 3:
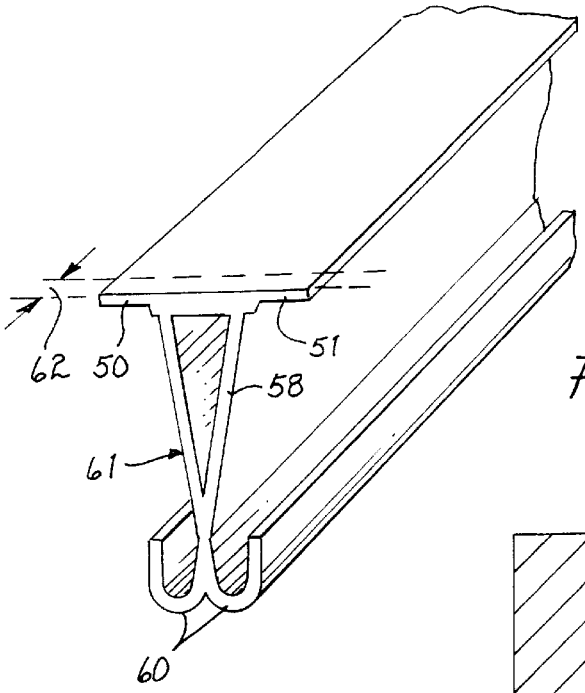
FIG. 3 is an isometric view of the embodiment shown in FIG. 2.

Referring to FIGS. 2 and 3, an embodiment of the masonry hanger of the present invention is shown for receiving and supporting a pair of rebars. The first and second supporting arms 50 and 51 extend transversely of the masonry wall 54 and extend a distance somewhat less than the transverse thickness of the wall. The vertical thickness of the support arms 50 and 51 are equal to or less than the horizontal mortar joint between the supporting block 56 and the course immediately above. The vertically extending hanger member 58 may be formed with two legs to provide strength and rigidity while the rebar supporting cradle 60 provides two channels within which to accommodate the rebar.

In addition to the choice of the material with which the hanger is made, the strength of the hanger may be chosen by its horizontal longitudinal length. That is, in those instances where the hanger is formed of extruded material, such as shown in FIG. 3, the length of the section that is cut or removed from the extrusion 61, such as that indicated in FIG. 3 by the distance 62, may be chosen to provide the desired strength to appropriately support the rebar required for the particular application. It may be noted that the hangers of the present invention are formed as a unitary structure and may be constructed as shown in FIG. 3 using extrusion techniques or alternatively could be formed by injection molding. In the embodiment shown in FIGS. 1 through 3, the hanger is supported by the upper surface of a supporting block where the support arms of the hanger contact the upper surface of the supporting block. The vertically extending hanger member extends through the void in the supporting block to position the rebar cradle within the grout or mortar channel in the course of masonry block immediately below the supporting block. The embodiment shown in FIG. 4 incorporates shorter vertically extending hanger members.

Figure 4:
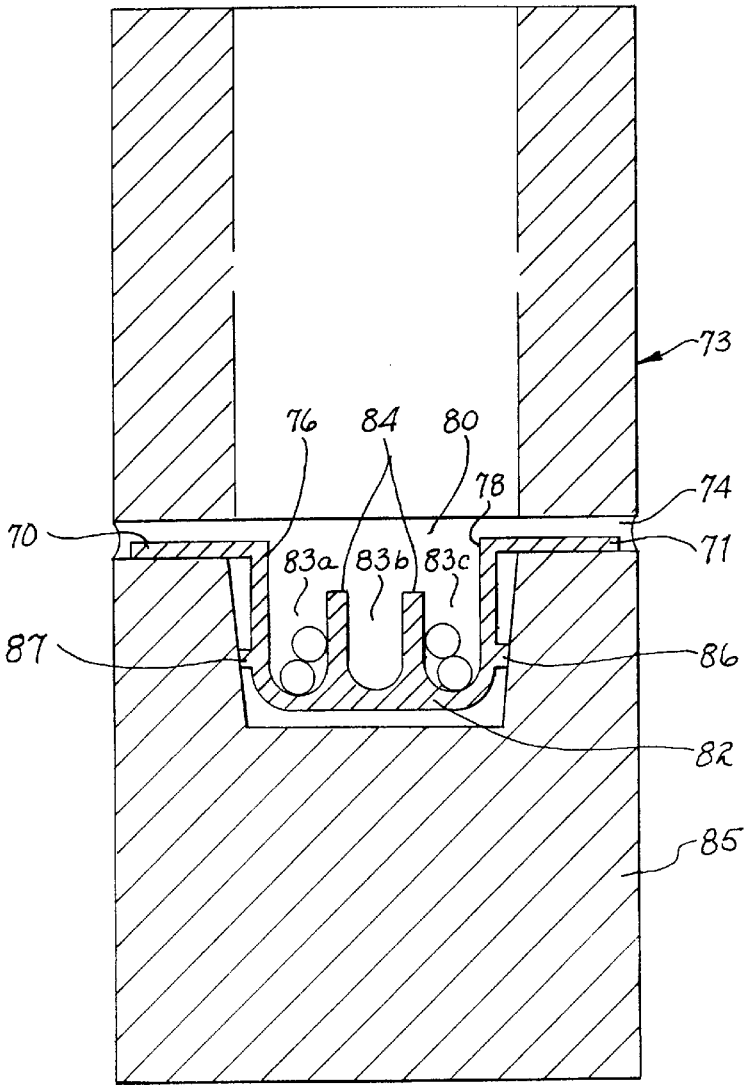
FIG. 4 is a cross-sectional view of another embodiment of a masonry hanger constructed in accordance with the teachings of the present invention illustrating a multiple rebar hanger.

Referring to FIG. 4, first and second support arms 70 and 71, respectively, extend transversely of the masonry block wall 73 a distance somewhat shorter than the transverse thickness of the wall. The vertical thickness of the arms 70 and 71 is equal to or less than the thickness of the grout joint 74 while the vertically extending hanger members 76 and 78, respectively, extend into the mortar channel 80 and terminate in a rebar cradle 82 for receiving multiple rebars. The embodiment chosen in FIG. 4 incorporates a rebar cradle 82 having multiple channels 83*a,* 83*b,* and 83*c* that may accommodate multiple rebars as shown in FIG. 4, or may be used for example to support a single rebar in the channel 83*b* provided in the cradle 82 and disposed centrally of the hanger and the supporting masonry block 85.

The Uniform Building Code stresses the importance of holding rebar in position during the addition of grout to the wall; the individual channels 83*a,* 83*b,* and 83*c* receive, support and cradle the rebar to maintain it in position. To insure this positioning, vertically extending dividers 84 separate the channels to thereby fix the transverse positioning of the rebar. The shape of the bottom of the channels 83*a,* 83*b,* and 83*c* may be chosen to accommodate a single rebar or multiple rebars, and may be tapered to more closely conform to the shape and diameter of the rebar to contact the rebar surface for securely holding the rebar in position.

The vertically extending hanger members of the embodiment of FIG. 4 incorporate horizontally extending masonry block contacting ridges 86 and 87, respectively, to assist maintaining the rebar and hanger position within the block and to limit any horizontal transverse movement of the hanger within the block. If the hanger is called upon to support a very heavy arrangement of rebar, the vertically extending members 76 and 78 and the supporting arms 70 and 71 may have a tendency to deform or bulge which may affect the appropriate positioning of the rebar within the block. The horizontally extending ridges 86 and 87 help to maintain the hanger in the proper transverse position within the masonry block and restrain any deformation such a bulging caused by the weight of the rebar.

Figure 5:
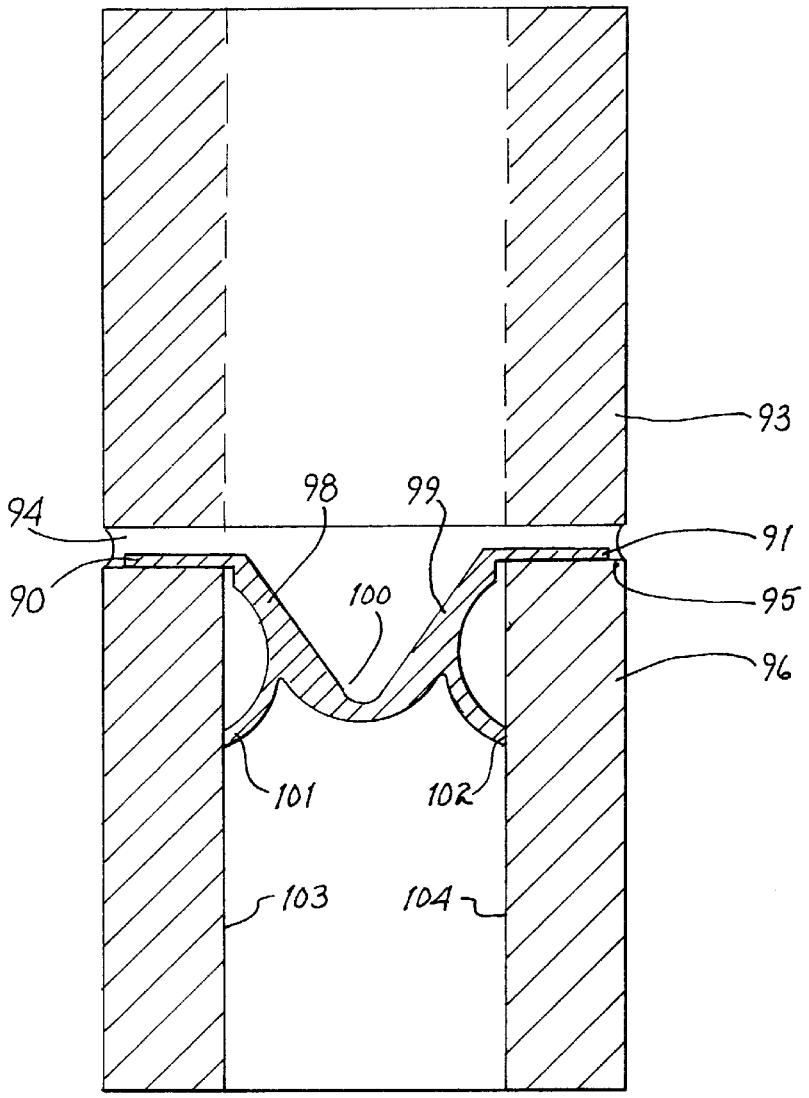
FIG. 5 is a cross-sectional view of another embodiment of a masonry hanger constructed in accordance with the teachings of the present invention illustrating a configuration incorporating horizontally extending ridges.
Figure 6:
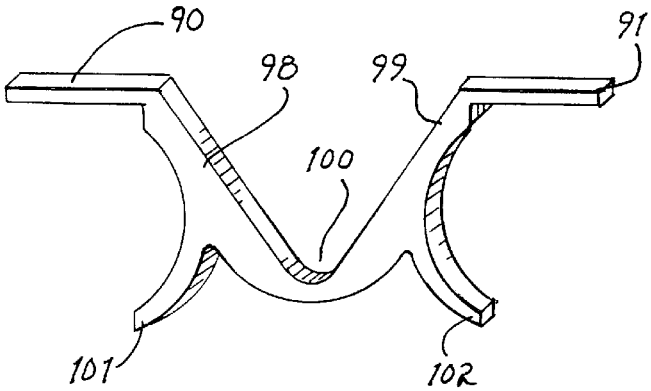
FIG. 6 is an isometric view of the embodiment shown in FIG. 5.

Referring now to FIGS. 5 and 6, another embodiment incorporating horizontally extending ridges is shown wherein the first and second supporting arms 90 and 91 extend transversely of the masonry wall 93 for a distance less than the transverse thickness of the wall. The supporting arms 90 and 91 have a vertical thickness equal to or less than the mortar joint 94 and are supported by the upper surface 95 of a supporting block 96. The vertically extending hanger members 98 and 99 form a V-shaped cradle 100 within which to receive a rebar; the hanger also incorporates ridges 101 and 102 that extend outwardly from the cradle 100 and contact the interior surfaces 103 and 104, respectively, of the masonry block 96. The horizontally extending ridges 101 and 102 assist to properly transversely position the hanger in the embodiment of FIG. 5 and also provide a means for limiting the deformation of the hanger resulting from a heavy rebar being supported thereby.

The present invention has been described in terms of a specific embodiment incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiment chosen for illustration without departing from the spirit and scope of the invention.

What is claimed is:

1. A reinforcing bar support for use in a masonry block wall having a plurality of masonry blocks arranged in courses and separated by grout joints and including at least one reinforcing bar extending longitudinally within said wall, said support comprising: a pair of support arms for positioning within a masonry block transversely of said wall and having a vertical thickness equal to or less than the grout joints of said wall; a hanger member formed integrally with said support arms extending vertically downwardly from said support arms for positioning within a void in a masonry block; said hanger member terminating in a rebar supporting cradle for receiving, supporting and maintaining in position a rebar within said masonry block wall.

2. The combination set forth in claim 1 wherein said supporting cradle includes a plurality of channels each for supporting a reinforcing bar.

3. A reinforcing bar support for use in the masonry block wall having a plurality of masonry blocks arranged in courses and separated by grout joints and including at least one reinforcing bar extending longitudinally within said wall, said support comprising: a pair of support arms for positioning within a masonry block transversely of said wall and having a vertical thickness equal to or less than the grout joints of said wall; a hanger member formed integrally with said support arms extending vertically downwardly from said support arms for positioning within a void in a masonry block; said hanger member having a ridge formed therein for contacting, when positioned in said wall, an interior surface of a masonry block; said hanger member terminating in a reinforcing bar supporting cradle for receiving, supporting and maintaining in position a reinforcing bar within said masonry block wall.

4. The combination set forth in claim 3 wherein said supporting cradle includes a plurality of channels each for supporting a reinforcing bar.

5. The combination set forth in claim 3 wherein said supporting cradle forms a "V".

6. A reinforcing bar support for use in a masonry block wall having a plurality of masonry blocks arranged in courses and separated by grout joints and including at least one reinforcing bar extending longitudinally within said wall, said support comprising: a pair of support arms for positioning within a masonry block transversely of said wall and having a vertical thickness equal to or less than the grout joints of said wall; a hanger member formed integrally with said support arms extending vertically downwardly from said support arms for positioning within a void in a masonry block; said hanger member terminating in a rebar supporting cradle for receiving, supporting and maintaining in position rebar within said masonry block wall; said cradle including at least one vertically extending divider to thereby separate and position a plurality of rebar.

7. A reinforcing bar support for use in the masonry block wall having a plurality of masonry blocks arranged in courses and separated by grout joints and including at least one reinforcing bar extending longitudinally within said wall, said support comprising: a pair of support arms for positioning within a masonry block transversely of said wall and having a vertical thickness equal to or less than the grout joints of said wall; a hanger member formed integrally with said support arms extending vertically downwardly from said support arms for positioning within a void in a masonry block; said hanger member having a ridge formed therein for contacting, when positioned in said wall, an interior surface of a masonry block; said hanger member terminating in a reinforcing bar supporting cradle for receiving, supporting and maintaining in position reinforcing bar within said masonry block wall; said cradle including at least one vertically extending divider to thereby separate and position a plurality of rebar.

* * * * *